US006191692B1

(12) United States Patent
Stoltz et al.

(10) Patent No.: US 6,191,692 B1
(45) Date of Patent: Feb. 20, 2001

(54) THEFT-DETERRENT DEVICE AND A LOCKING ELEMENT AND A RELEASE DEVICE FOR A THEFT-DETERRENT DEVICE

(75) Inventors: Klas Stoltz; Bo Gustavsson, both of Gökvägen (SE)

(73) Assignee: Färgklämman AB, Huddinge (SE)

( * ) Notice: Under 35 U.S.C. 154(b), the term of this patent shall be extended for 0 days.

(21) Appl. No.: 09/274,357

(22) Filed: Mar. 23, 1999

(30) Foreign Application Priority Data

Apr. 1, 1998 (SE) ..... 9801154

(51) Int. Cl.[7] ..... G08B 13/14
(52) U.S. Cl. ..... 340/572.9; 340/572.1
(58) Field of Search ..... 340/572.9, 572.1

(56) References Cited

U.S. PATENT DOCUMENTS

| | | | | |
|---|---|---|---|---|
| 3,806,910 | | 4/1974 | Keifer et al. . | |
| 4,380,097 | * | 4/1983 | Keifer | 340/572.9 X |
| 4,651,136 | | 3/1987 | Anderson et al. . | |
| 4,685,234 | * | 8/1987 | Anderson et al. | 340/572.9 X |
| 4,774,504 | * | 9/1988 | Hartings | 340/572.9 X |
| 5,366,254 | | 11/1994 | Tucchio et al. . | |
| 5,426,419 | * | 6/1995 | Nguyen et al. | 340/572.9 |
| 5,864,290 | * | 1/1999 | Toyomi et al. | 340/572.1 |
| 5,942,978 | * | 8/1999 | Shafer | 340/572.9 |

FOREIGN PATENT DOCUMENTS

| | | |
|---|---|---|
| 2 683 871 | 5/1993 | (FR) . |
| 2 166 185 | 4/1986 | (GB) . |

* cited by examiner

*Primary Examiner*—Thomas Mullen
(74) *Attorney, Agent, or Firm*—Browdy and Neimark

(57) ABSTRACT

The invention relates to a theft-deterrent device intended to be attached to and locked on theft-attractive goods and constructed to co-act with a release device (14) for releasing the theft-deterrent device from said goods (12). The theft-deterrent device includes a first element (2) comprising a base element (4) and a connecting element (6) which projects out from the base element and is intended to be inserted through said goods, and a locking element (8) which is intended to be attached to and locked on said connecting element such as to prevent movement in a direction away from the base element and therewith to hold the anti-theft device securely on said goods. The locking element (8) can be released from the connecting element (6) by means of a temperature-dependent change in form of a release-part (66) provided in the locking element (8) and comprised of a material that has memory properties. The invention also relates to a locking element and to a release device for a theft-deterrent device.

21 Claims, 2 Drawing Sheets

THEFT-DETERRENT DEVICE AND A LOCKING ELEMENT AND A RELEASE DEVICE FOR A THEFT-DETERRENT DEVICE

A theft-deterrent device and a locking element and a release device for a theft-deterrent device.

The present invention relates to a theft-deterrent device which is intended to be attached to and locked on theft-attractive goods and which is designed to co-act with a release device for releasing the theft-deterrent device from said goods. The theft-deterrent device comprises a first element consisting in a base element and a connecting element which projects out from the base element and which is intended to be inserted through the item of goods to be protected, and a locking element which can be attached to the connecting element and locked thereon against movement away from the base element, so as to hold the theft-deterrent device securely on item of goods concerned. The invention also relates to a locking element and a release device for a theft-deterrent device.

Anti-theft devices, or theft deterrents, of this kind are used with the intention of preventing or deterring the theft of theft-attractive goods, such as clothing, bags, handbags, suitcases and other retail articles that can be easily carried. A device of this kind is intended to be attached to an item of goods in a manner such that the device can only be released with the aid of a special release device, to which potential thieves are assumed not to have access. The intention is, of course, that only authorised persons, for instance till operators, or cash register operators, shall have access to such a release device. Attempts to remove the theft-deterrent device without the aid of the special release device will greatly impair the goods, or render them unusable, either by tearing the goods or by causing a fragile ampul provided in the theft-deterrent device and containing a staining substance to fracture and release the staining substance so as to stain the goods or damage the goods in some other way. The theft-deterrent device may also carry an alarm element forming part of an alarm system either as an alternative to or complementary to one or more ampuls containing a staining or marking substance, said alarm system being adapted to be triggered by a sensor arrangement at the exits of the store in which the theft-attractive goods are offered for sale.

Normally, theft-deterrent devices of the kind defined in the introduction have locking elements that can be released with the aid of magnetic release devices. Consequently, so-called pirate release devices have been developed and used with some success to release the locking element unlawfully from the connecting element without the aid of the special release device and thereby render the theft-deterrent device inactive.

The object of the present invention is to provide a structurally simple and therewith inexpensive theft-deterrent device of the aforesaid kind that is more secure against unlawful release of the locking function of said device than earlier known devices of this kind.

This object is achieved in accordance with the invention by means of a theft-deterrent device, a theft-deterrent device locking element and an associated release device that have the characteristic features set forth in the following Claims.

According to the invention, the locking element includes a locking unit that is made either completely or partially of a material that has special memory properties, i.e. a material that when deformed will strive to return to its original form, such as its shape or state, in response to a change in temperature. Metal alloys that have special memory properties, so-called memory metals, are preferably used in this regard. The term memory metal is a term commonly used to describe metal alloys that have a memory ability, i.e. a material which when subjected to deformation can be caused to return to its original form by changing its temperature. A memory metal can have memory properties in the form of a so-called one-way memory, meaning that an article subjected to deformation will return to its original form in response to a temperature change, the number of times that this procedure can be effected being almost unlimited. A memory metal may also have two-way memory properties, meaning that in addition to returning to its original form in response to an increase in temperature, the metal is also able to take a predetermined deformed form in response to a lowering of the temperature.

Ordinary metal alloys that have memory properties are comprised of a number of variants within the nickel-titanium system. Other examples of possible alloys are copper-zinc-aluminium alloys, aluminium-nickel alloys, copper-aluminium-nickel alloys and iron-based memory metals.

Plastic materials and ceramic materials are examples of other possible materials having memory properties.

Thus, in accordance with the invention, the connecting element is released from the locking element by movement of a locking unit in the locking element to a release position by means of a temperature change of the locking unit. This temperature change can be achieved in many different ways within the scope of the invention and may be an increase or a decrease in temperature.

In one preferred embodiment of the invention, the change in temperature in the locking unit is achieved by heating a memory metal in the locking unit inductively. Inductive heating of a metal object, such as the locking unit in this case, said locking unit being made either completely or partially of a memory metal, is achieved by placing the locking unit within or closely adjacent to a coil through which an alternating current passes. Eddy currents are thus induced in the metal and heat is generated in the proximity of the eddy currents, due to the resistance in the material concerned. In this preferred embodiment of the invention, a coil supplied with alternating current is disposed in the release device in a manner which enables the locking unit in said locking element to be placed in or in the close proximity of the coil and therewith to be heated inductively so as to release the connecting element.

This inductive heating of the locking unit has important advantages, since the heat is developed immediately and directly in the actual metal of the locking unit. The change in the temperature of the memory metal required to change the form of said locking unit takes place very rapidly, so as to enable a quick release of the connecting element from the locking element.

Within the scope of the invention, temperature changes in the material can also be achieved in other ways, for instance by utilising the so-called Peltier effect, by delivering heat or cold directly to the material through a specially designed nozzle, or in some other suitable way.

A temperature change of the magnitude required to change the form of the locking unit to a release form cannot be achieved readily by an unauthorised person, which makes pirate equipment for releasing the inventive theft-deterrent device from an item of goods difficult to manufacture. An unauthorised person cannot tell from the outside of the device how the two elements can be released from one another. The locking unit is conveniently enclosed in a plastic casing which softens when heated, which makes endeavours to unlawfully release the theft-deterrent device by heating the locking unit from outside the locking element difficult to achieve. The locking unit may also be surrounded by an insulating material which makes it difficult, or impossible, to effect the necessary change in temperature of the locking unit by supplying heat or cold thereto from the outside. An ampul containing a staining substance comprised in the theft-deterrent device may include or have externally connected thereto an alarm element which prevents the item of goods to which the theft-deterrent device is attached from being removed from the store or shop so that the theft-deterrent device can be manipulated in some other place.

In one preferred embodiment of the invention, the connecting element is released by a direct and/or indirect change of form, such as its shape, in a direction essentially radially in relation to the connecting element. By causing movements in a radial direction in this way, there is provided the advantage that only very small movements are required in order to positively release the connecting element. The operational reliability of the device is thus very high. The construction of the locking element, and primarily that of the locking unit, is very simple and may comprise only a few components, these components being easily fitted and requiring relatively small space. As a consequense, the locking element, and thus the theft-deterrent device, are light in weight and inexpensive in manufacture.

The invention will now be described in more detail with reference to the accompanying drawings, in which FIG. 1 is an explanatory illustration of an theft-deterrent device and a co-acting release device in accordance with one embodiment of the invention;

Figure 1:
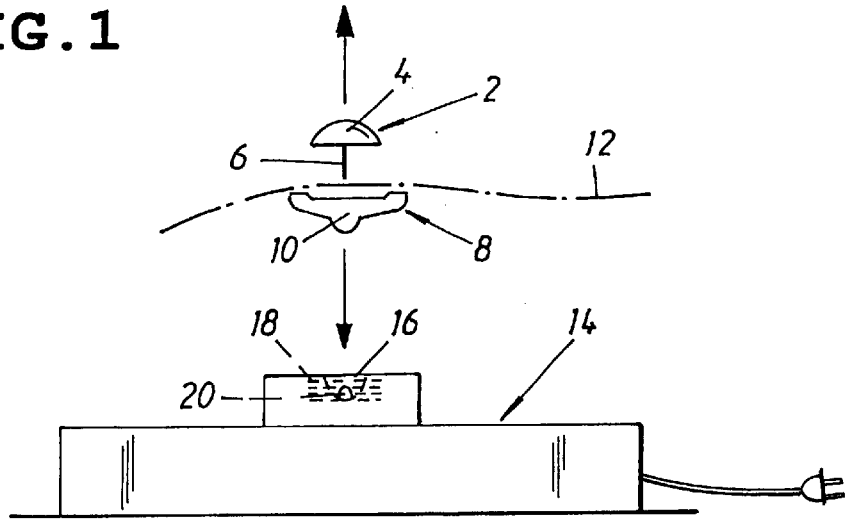

FIG. 1 is an explanatory illustration of an inventive theft-deterrent device and a coacting release device. The theft-deterrent device is comprised of two units, a first element 2 that includes a base element 4 and an elongated, connecting element 6 which projects out from the base element, and a second element 8 that includes a locking unit 10. The connecting element 6 is intended to be inserted through the item of goods 12 to be protected, whereafter the second element 8, the locking element, is attached and locked to the connecting element 6.

The locking unit 10 can be made inactive, so as to enable the two elements 2, 8 to be released from each other and from the item of goods 12, with the aid of a special release device 14. The release device 14 has a seat 16 which is adapted to accommodate the locking element 8 and the locking unit 10 and in which the bottom-part of the locking element 8 can be placed for releasing the locking unit 10 from the connecting element 6. The release device 14 includes a current-carrying coil 18 disposed around the seat 16. An electric contact device 20 may be placed in the bottom of the seat, said contact device being actuated for connection of the coil 18 to a source of electric current, by means of a locking element 8 that is placed in the seat 16. As described above, heat is induced in the locking unit 10 as alternating current flows through the coil 18.

One or both of the two elements 2, 8 may include one or more ampuls which contain a staining substance and which are adapted to fracture or burst when an attempt is made to remove the anti-theft device from the item of goods 12 without using the special release device 14, so that staining substance contained in the ampul/ampules will be released and stain the item of goods 14 or damage said goods in some other way. The elements 2, 8 may also be provided with an alarm element for electronic alarm systems instead of, or as a supplement to, staining-substance containing ampuls. An alarm element may conveniently be enclosed in the ampul together with the staining substance. It will be understood that the locking element 8 may be used solely as a locking element without including a staining-substance containing ampul or an alarm element.

Figure 2:
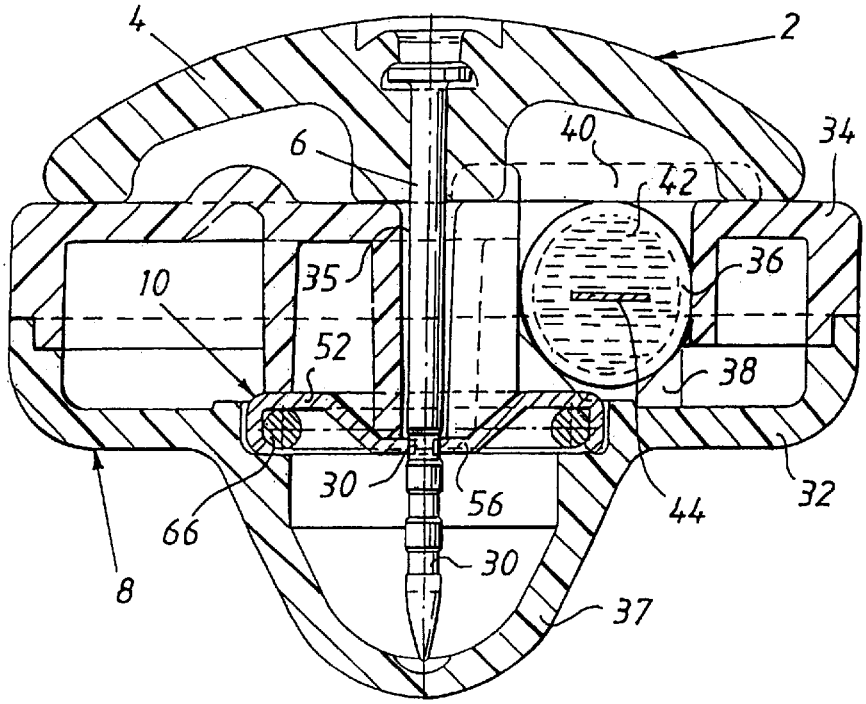
FIG. 2 is a sectioned view of one embodiment of an inventive theft-deterrent device.

FIG. 2 is a section view of an inventive theft-deterrent device. The two elements of said device, i.e. the first element 2 with the outwardly projecting connecting element 6, and the second element or locking element 8, are intended to be fastened to one another together with the item of goods to be protected (not shown in FIG. 2) disposed between said two elements 2, 8.

The first element 2 includes a base element 4, preferably made of plastic or metal, and the needle or pin-shaped connecting element 6, preferably made of metal, which is attached to and projects out from the base element 4. The connecting element 6 includes on its outer part a plurality of circular grooves 30 which are intended to coact with the locking unit 10 in a manner described in more detail hereinafter.

The second element 8, which constitutes the locking element, includes a casing that is comprised of a bottom-part 32 and a lid or cover 34 which is welded to said bottom-part or fixed permanently thereto in some other way. The casing parts are preferably made of a plastic material. The cover 34 of said casing has a central opening 35 through which the connecting element 6 is inserted. The bottom-part 32 includes a centrally positioned male-part 37, which in the locked position of the elements 2, 8 accommodates the outer part of the connecting element 6 and which is adapted to coact with the seat 16 of the release device, as described above with reference to FIG. 1.

A circular-cylindrical ampul 36 made of glass or some other fragile material is enclosed between the bottom-part 32 and the cover part 34 of the casing. The ampul 36 may be affixed at the end-parts of the ampul between the oblique support surfaces 38 in the bottom-part 32 and the upwardly projecting shoulders 40 in the cover part 34. The ampul 36 will primarily include a staining substance 42, and may also enclose an alarm element 44 that is intended to be sensed by an electronic alarm system (not shown).

A locking unit 10 is disposed centrally in the locking element 8 and held firmly between the bottom-part 32 and the cover part 34 of said casing. The locking unit 10 is designed to receive and lock the connecting element 6 and is held clamped between the cover part and the bottom-part 34, 32 in a manner such that any attempt to forcibly loosen the first element 2 from the locking element 8 will cause the locking unit 10 to move together with the connecting element 6 to some extent and therewith cause the ampul 36 to break and release the enclosed staining substance.

The locking unit 10 includes a generally circular lock plate 52 that includes a plurality, preferably two, locking tongues 56, and also a generally ring-shaped release-part 66 that co-acts with the lock plate 52. The locking tongues 56 are adapted to receive the connecting element 6 when said element is moved into the insertion opening 35 and to lock the connecting element 6 when an attempt is made to move the connecting element in a direction out of the insertion opening 35.

Figure 3:
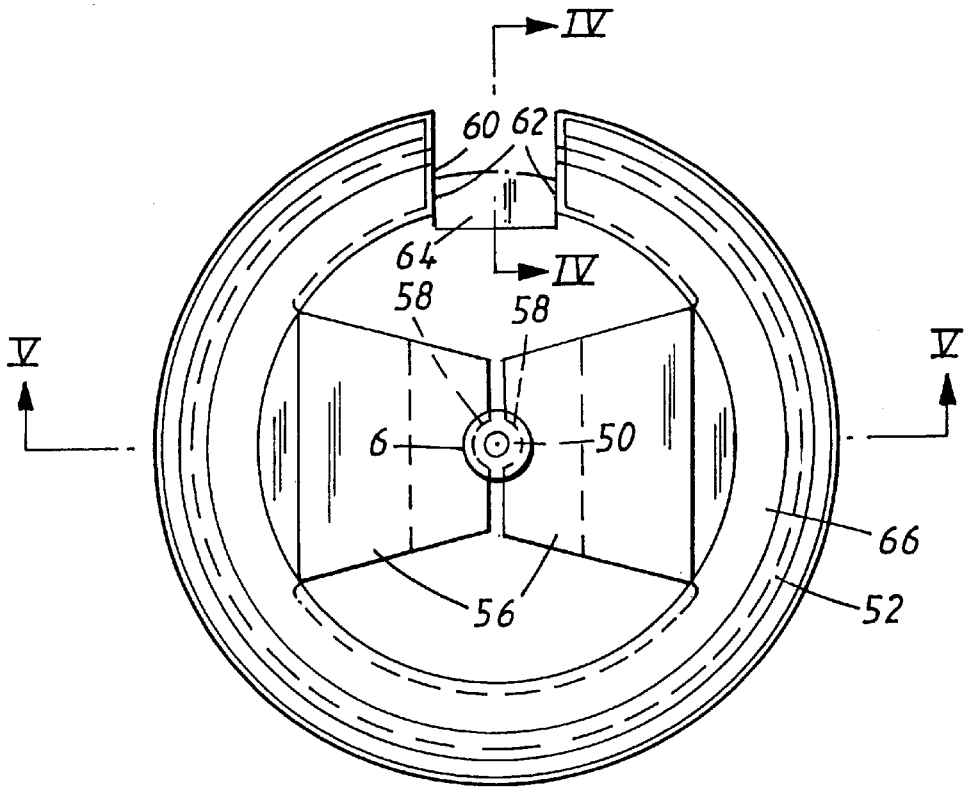
FIG. 3 shows the locking unit of FIG. 2 from beneath, with surrounding parts being omitted for the sake of clarity.
Figure 4:
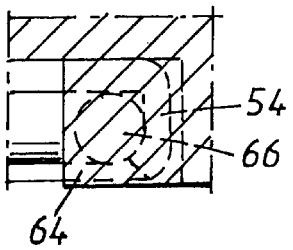
FIG. 4 is a sectioned view taken on the line IV—IV in FIG. 3.
Figure 5:
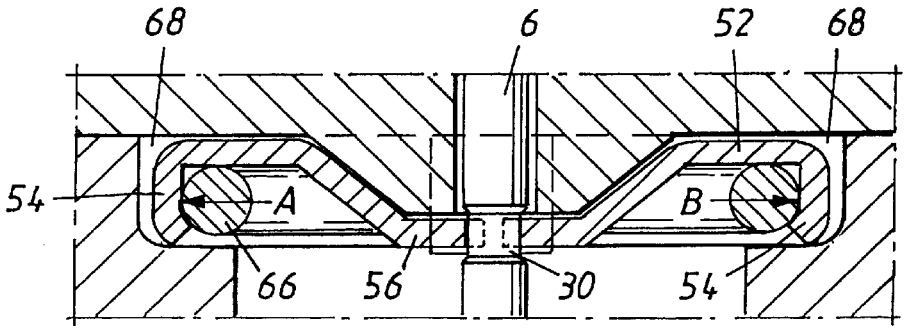
FIG. 5 is a sectioned view taken on the line V—V in FIG. 3.

A preferred embodiment of the locking unit 10 in FIG. 2 is shown in more detail in FIGS. 3–5. The locking unit 10 includes a generally circular lock plate 52 that has an outer, generally circular edge-part 54 (see FIG. 5). The lock plate 52 carries two or more opposing locking tongues 56 which face towards the centre of the circle and which include centrally disposed part-circular recesses 58 which together define a lock opening 50 for accommodating the connecting element 6.

In the preferred embodiment, the lock plate 52 is a one-piece structure and has an opening 60 provided in its circular part. The opening 60 is disposed on the circular-arc between the locking tongues 56, preferably midway between said locking tongues, and the end-surfaces 62 of the lock plate 52 are in abutment with a locking shoulder 64. The locking shoulder 64 constitutes part of the bottom-part 32, and the end-surfaces 62 of the lock plate 52 are hereby fixed against the locking shoulder and the casing, as will be evident from the following text.

The lock plate is made of a resilient material and may be punched and bended from metal sheet, such as spring bronze, stainless spring steel or some other suitable material. One essential feature of the lock plate, however, is that it is formed from a material such that and is dimensioned such that the lock plate and associated locking tongues are resilient. As will be seen particularly from FIG. 5, the lock plate 52 is disposed in the locking element 8 so as to be surrounded by an open gap 68 between the edge-part 54 of the lock plate and the bottom-part of the locking element 8.

A generally circular release-part 66 is disposed in the lock plate 52 and abuts the inner surface of the cylindrical edge-part 54. In the illustrated embodiment, the release-part 66 extends from the locking shoulder 64 and one end-part 62 of the lock plate to the other end-part 62 of the lock plate and the locking shoulder 64, such that also the two end-parts of the release-part 66 abut the locking shoulder 64.

The release-part 66 is made of a material that has memory properties, in the preferred embodiment from a memory metal, and will thus strive to return to its original shape when subjected to a change in temperature. The original shape of the release-part 66 is thus not the fully circular shape shown in FIG. 3, but has more of an oval shape with the major axis lying on the line V—V in FIG. 3 and in the plane of the paper in FIG. 2.

The locking element is released by placing the male-part 37 of said locking element in the seat 16 on the release device 14, wherewith the electric contact element 20 in the bottom of the seat is actuated to connect the coil 18 to an A.C. source. Heat is therewith induced immediately in the release-part 66 which then strives to return to its original oval shape . This change in the form of the release-part 66 results in outwardly acting forces which press against the inside of the lock plate 52 and its edge-parts 54 in the directions of arrows A and B (see FIG. 5), whilst the end parts of the release-part 66 lie supportingly against the locking shoulder 64. As a result of these internal pressure forces, the resilient lock plate 52 will expand within the scope of the open gap 68, therewith causing the locking tongues 56 on said lock plate to separate and open in the radial direction of the connecting element 6. The locking tongues 56 therewith release their grip on the connecting element 6, therewith allowing the connecting element to be released from the locking element.

In one preferred embodiment, the circular grooves 30 in the connecting element 6 have a depth of about 0.1 mm. In the case of this preferred embodiment, the form-change in the radial direction of the connecting element required to release the connecting element is, in total, not greater than about 0.3 mm. Thus, in the case of the illustrated embodiment, the temperature-dependent change in the form of the release-part 66 is transferred immediately to an opening movement of the locking tongue 56, therewith providing the advantage of requiring only a very small change to provide a positive opening movement.

It will be understood that the invention is not restricted to the aforedescribed exemplifying embodiment thereof and that several modifications are conceivable within the scope of the following Claims. For instance, the two mutually co-acting parts of the locking unit 10, i.e. the resilient lock plate and the release-part, whose form can be changed, may structurally be different to what has been described with reference to the illustrated embodiment. It will be understood that the release-part may have a suitable shape other than the open, circular shape and may therewith also have an original shape other than an oval shape. The release-part may also comprise several mutually discrete parts that co-act to releasably move the locking tongues. However, it is essential with regard to optimum use of the form-changing force that the locking unit is so constructed that essentially the whole of said force is utilised in releasing the locking tongues. In order to utilise this force to a maximum, it is also necessary to arrange the release-part in the casing of the locking element so as to enable the counter-forces to be taken up, which is effected by causing the release-part to abut a counterpressure means, or anvil surface, fixed in the casing. The release-part may alternatively be constructed so that these counter-forces will be taken up in the actual release-part, for instance when said part has the form of a closed ring. The resilient lock plate may also have a form different to that shown, and the number of locking tongues may be more than two. The release-part and the lock plate may also be combined into a single unit.

In the illustrated case, the locking tongues open in a radial direction in relation to the connecting element. However, the locking tongues may alternatively be opened in another way, for instance by means of an arcuate movement that can be achieved by the releasing forces from the release-part acting against the lock plate in the axial direction of the connecting element.

According to this embodiment, the release-part may alternatively be generally ring-shaped with a temperature-dependent change in form in the radial direction of the release-part, which in this case coincides with the axial direction of the connecting element. The locking tongues will therewith describe generally a pivotal or rotational movement between the locked position of the connecting element and the release position.

What is claimed is:

1. A theft-deterrent device intended to be attached to and locked on theft-attractive goods, said device including a first element (2) which comprises a base element (4) and a connecting element (6) which projects out from the base element and which is intended for insertion through the goods (12) to be protected, and a locking element (8) which is adapted to be attached to and locked on the connecting element (6) against movement in a direction away from the base element (4) so as to hold the theft-deterrent device securely on said goods (12), said theft-deterrent device being constructed to co-act with a release device (14) for releasing the theft-deterrent device from said goods (12), characterised in that said locking element (8) is adapted to be released from the connecting element (6) by means of a temperature-dependent change in the form of a release-part (66) disposed in the locking element (8) and comprised of a material having memory properties.

2. A theft-deterrent device according to claim 1, characterised in that the connecting element (6) is intended to be inserted into and locked in a locking unit (10) in the locking element (8), said locking unit (10) including said release-part (66) and at least two locking tongues (56) which are adapted to grip around and lock said connecting element (6) in a non-actuated position and to move to a release position in response to a change in the form of said release-part (66).

3. A theft-deterrent device according to claim 2, characterised in that the locking unit (10) comprises two mutually co-acting parts, one of which being said release-part (66) and the other being a resilient lock plate (52) that includes said locking tongues (56).

4. A theft-deterrent device according to claim 3, characterised in that the connecting element (6) is released through the change in the form of the release-part (66) in a generally radial direction in relation to said connecting element (6).

5. A theft-deterrent device according to claim 4, characterised in that the locking tongues (56) are movable to a release position in a generally radial direction relative to said connecting element (6).

6. A theft-deterrent device according to claim 5, characterised in that the change in the form of the release-part (66) is transferred to the resilient lock plate (52) that carries the locking tongues (56).

7. A theft-deterrent device according to claim 3, characterised in that the locking tongues (56) are movable to a release position in a generally radial direction relative to said connecting element (6).

8. A theft-deterrent device according to claim 7, characterised in that the change in the form of the release-part (66) is transferred to the resilient lock plate (52) that carries the locking tongues (56).

9. A theft-deterrent device according to claim 8, characterised in that the release-part (66) is generally circular in shape, said connecting element (6) being released as a result of a change in the form of said release-part (66) in a generally radial direction of said release-part.

10. The theft-deterrent device of claim 3 wherein the change in the form of the release-part (66) is transferred to the resilient lock plate (52) that carries the locking tongues (56).

11. A theft-deterrent device according to claim 2, characterised in that the locking tongues (56) are movable to a release position in a generally radial direction relative to said connecting element (6).

12. A theft-deterrent device according to claim 1 characterised in that the change in the form of the release-part (66) is transferred to a resilient lock plate (52) that carries the locking tongues (56).

13. A theft-deterrent device according to claim 1, characterised in that the release-part (66) is made either totally or partially of a metal material having memory properties.

14. A theft-deterrent device according to claim 1, characterised in that the form of the release-part (66) is changed in response to an increase in temperature.

15. A theft-deterrent device according to claim 14, characterised in that the temperature of the release-part (66) is increased by inductive heating.

16. A theft-deterrent device according to claim 1, characterised in that the form of the release-part (66) is changed in response to a decrease in temperature.

17. A theft-deterrent device according to claim 1, characterised in that the release-part (66) is generally circular in shape, said connecting element (6) being released as a result of a change in the form of said release-part (66) in a generally radial direction of said release-part.

18. A release device for a theft-deterrent device intended to be attached to and locked on theft-attractive goods, said theft-deterrent device including a first element (2) which comprises a base element (4) and a connecting element (6) which projects out from the base element and which is intended for insertion through the goods (12) to be protected, and a locking element (8) which is adapted to be attached to and locked on the connecting element (6) against movement in a direction away from the base element (4) so as to hold the theft-deterrent device securely on said goods (12), characterised in that the release device is constructed to receive said locking element (8) and cause, either directly or indirectly, a change in temperature of a release-part (66) in the locking element (8).

19. A release device according to claim 18, characterised in that the release device (14) includes a coil (18) that can be connected to a source of alternating current, said release part (66) of the locking element (8) being heated inductively when the coil is connected to said alternating current source.

20. A release device according to claim 19, characterised in that the release device (14) includes a seat (16) for receiving said locking element (8), said coil (18) being disposed around said seat (16).

21. A release device according to claim 20, characterised in that the seat (16) includes an electric contact means which is actuated by a locking element (8) received in the release device (14) such as to connect said coil to said alternating current source.

* * * * *